United States Patent [19]

Ball et al.

[11] Patent Number: 4,722,170

[45] Date of Patent: Feb. 2, 1988

[54] UPPER GUIDED LOWER DRIVEN STRETCH WRAPPING DEVICE

[75] Inventors: Ronald G. Ball, Anchorage; Robert B. Denley, Louisville, both of Ky.

[73] Assignee: Lantech, Inc., Louisville, Ky.

[21] Appl. No.: 929,840

[22] Filed: Nov. 13, 1986

[51] Int. Cl.[4] ..... B65B 13/04

[52] U.S. Cl. ..... 53/556; 53/588

[58] Field of Search ..... 53/556, 588, 210; 212/418

[56] References Cited

U.S. PATENT DOCUMENTS

| | | | |
|---|---|---|---|
| 3,793,798 | 2/1974 | Lancaster et al. | 53/588 |
| 4,050,220 | 9/1977 | Lancaster | 53/556 |
| 4,067,174 | 1/1978 | Goldstein | 53/588 |
| 4,109,445 | 8/1978 | Shulman | 53/588 |
| 4,181,231 | 1/1980 | Morrissey | 212/218 X |
| 4,282,700 | 8/1981 | Goldstein | 53/588 X |
| 4,358,020 | 11/1982 | Thiele | 212/218 |

OTHER PUBLICATIONS

PS&D Manual, "Heatless Stretch Wrap".

*Primary Examiner*—John Sipos
*Attorney, Agent, or Firm*—Finnegan, Henderson, Farabow, Garrett & Dunner

[57] ABSTRACT

A stretch wrapper wraps a load with a web dispensed from a web dispenser and includes a frame for supporting and revolving the web dispenser around the load and about a vertical axis. A support is attached to the upper portion of the frame to support the frame from above and guide the frame along a path around the load. A motor-driven drive wheel is attached the lower portion of the frame for engaging a floor, supporting the frame from below, and driving the frame on the floor along the path around the load.

19 Claims, 7 Drawing Figures

UPPER GUIDED LOWER DRIVEN STRETCH WRAPPING DEVICE

BACKGROUND OF THE INVENTION

The present invention relates to a stretch wrapping device for wrapping a film web around a load in a packaging operation.

A variety of stretch wrapping machines have been developed to wrap a load with a stretched film web in order to contain and cover the load. One of the most popular uses of stretch wrapping is to unitize a number of small packages with a pallet base so that they can be handled together as a larger unit.

Extremely effective stretch wrapping devices are available to perform this function such as those shown in U.S. Pat. Nos. 4,418,510 and 4,302,920 to Lancaster et al., and assigned to Lantech, Inc., which are incorporated herein by reference. However, a need has existed for a simplified inexpensive stretch wrapping device which does not have to be supported by a strong and extensive structural framework, yet which continues to be durable and reliable in operation.

There also exists the need for a stretch wrapping device which may be easily and inexpensively shipped and which is portable and easily assemblable at the point of use.

There is also a need for a stretch wrapping device which occupies little or no floor space and which provides little or no obstruction on the floor which would interfere with positioning the pallet load in the wrapping position and also which would interfere with other operations taking place in the vicinity of the stretch wrapping device.

There also exists the need for a stretch wrapping device which has the ability to effectively wrap a load in a wrapping area where the floor is uneven without specially customizing the stretch wrapping device or putting a strain on the stretch wrapping device.

There is also a need for a stretch wrapping device which can be effectively positioned between two loading bays so that loads passing through each loading bay may be moved easily into the wrapping position without interference with the stretch wrapping machine.

Accordingly, it is an object of the present invention to provide a stretch wrapping device which does not have to be supported by a strong and extensive structural framework, yet which continues to be durable and reliable in operation.

It is also an object of the present invention to provide a stretch wrapping device which may be easily and inexpensively shipped and which is portable and easily assemblable at the point of use.

It is another object of the present invention to provide a stretch wrapping device which occupies little or no floor space and which provides little or no obstruction on the floor which would interfere with positioning the pallet load in the wrapping position and also which would interfere with other operations taking place in the vicinity of the stretch wrapping device.

It is further an object of the present invention to provide a stretch wrapping device which has the ability to effectively wrap a load in a wrapping area where the floor is uneven without specially customizing the stretch wrapping device or putting a strain on the stretch wrapping device.

It is an additional object of the present invention to provide a stretch wrapping device which can be effectively positioned between two loading bays so that loads passing through each loading bay may be moved easily into the wrapping position without interference with the stretch wrapping machine.

Additional objects and advantages of the invention will be set forth in the description which follows, and in part will be obvious from the description, or may be learned by practice of the invention. The objects and advantages of the invention may be realized and obtained by means of instrumentalities and combinations particularly pointed in the appended claims.

SUMMARY OF THE INVENTION

To achieve the foregoing objects, and in accordance with the purposes of the invention as embodied and broadly described herein, an apparatus is provided for wrapping a load with a web dispensed from a web dispenser comprising: frame means for supporting and revolving the web dispenser around the load and about a vertical axis, the frame means having an upper portion and a lower portion; support means attached to the upper portion of the frame means for supporting the frame means from above and for guiding the frame means along a path around the load; drive means attached to the lower portion of the frame means for engaging a floor, supporting the frame from below, and driving the frame means on the floor along the path around the load.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiments given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention an apparatus is provided for wrapping a load with a web dispensed from a web dispenser comprising: frame means for supporting and revolving the web dispenser around the load and about a vertical axis, the frame means having an upper portion and a lower portion; support means attached to the upper portion of the frame means for supporting the frame means from above and for guiding the frame means along a path around the load; and drive means attached to the lower portion of the frame means for engaging a floor, supporting the frame means from below and driving the frame means on the floor along the path around the load.

Figure 1:
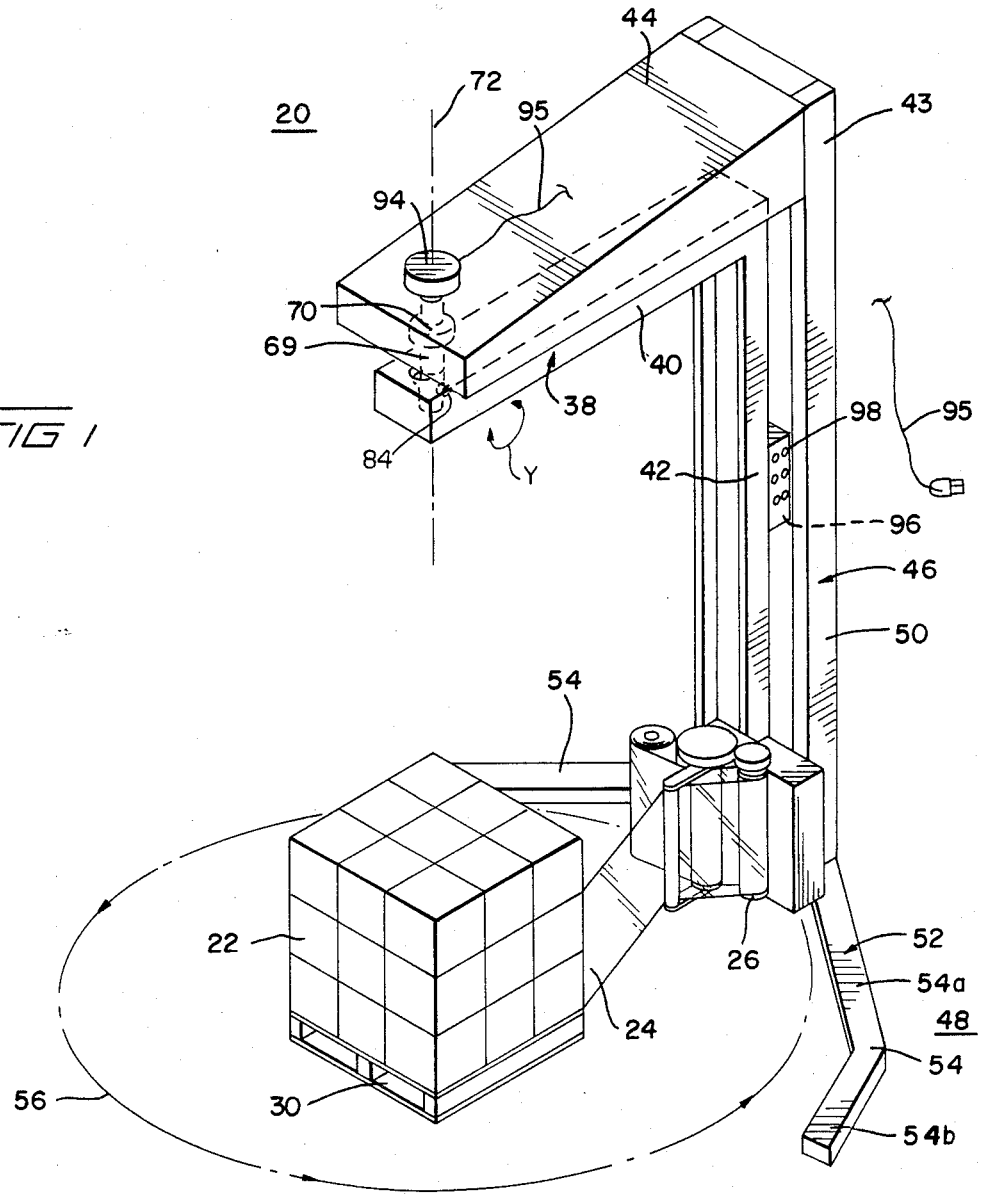
FIG. 1 is a perspective view of a stretch wrapping device incorporating the teachings of the present invention.
Figure 2:
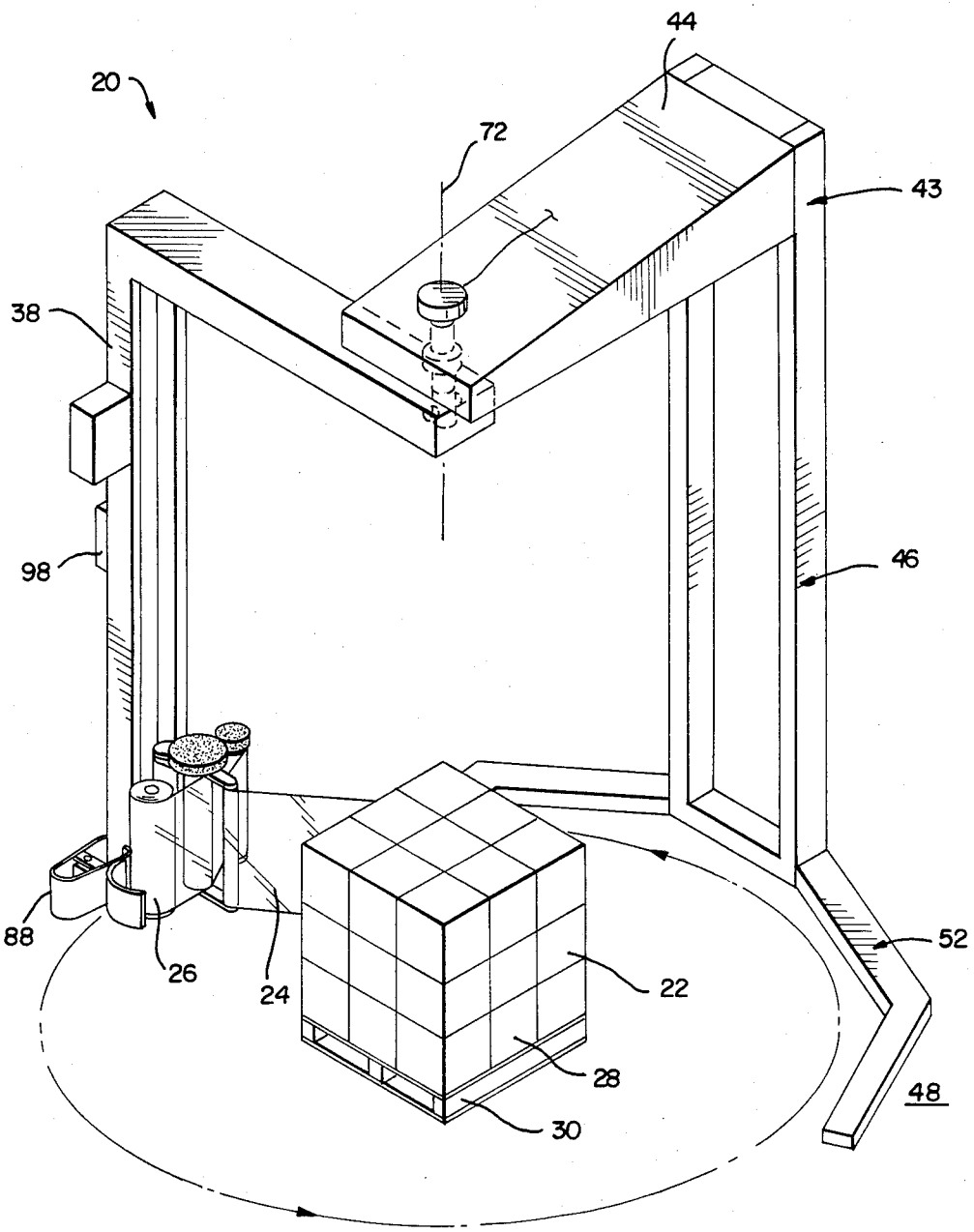
FIG. 2 is a perspective view of the stretch wrapping device illustrated in FIG. 1 in a second position during a stretch wrapping operation.
Figure 6:
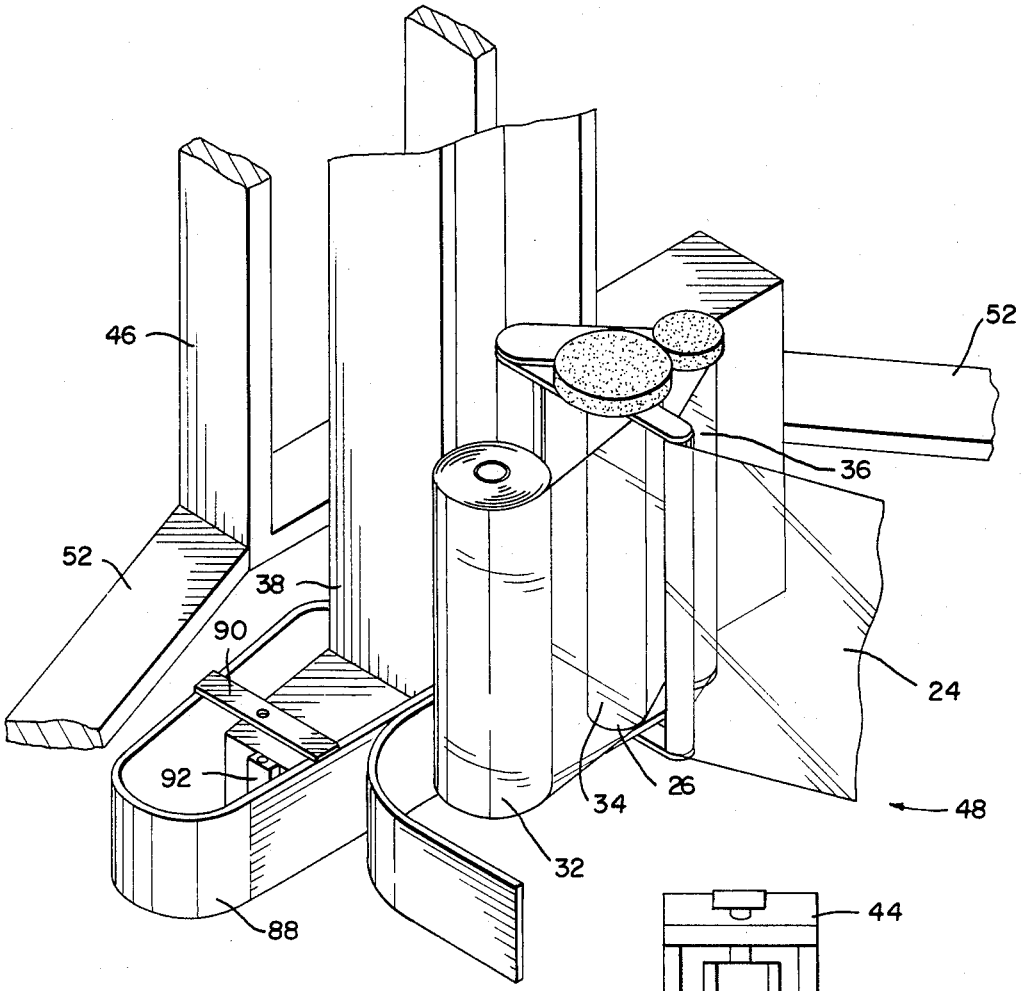
FIG. 6 is a perspective view of a portion of the arrangement shown in FIG. 1.

As embodied and shown in FIGS. 1 and 2, the apparatus for wrapping a load includes a stretch wrapping device 20 which wraps a load 22 with a web 24 dispensed from a web dispenser 26. Load 22 is shown to include a plurality of sub-units 28 stacked on a pallet 30. Web 24 includes a film web of the type used in conventional stretch wrapping devices. As best shown in FIG. 6, web dispenser 26 supports a roll 32 of film web 24, conventional prestretch rollers 34 and 36 through which film web 24 is threaded to stretch the film.

According to the present invention there is provided a frame means for supporting and revolving the web dispenser around the load and about a vertical axis, the frame means having an upper portion and a lower portion. It is preferable that the frame means includes a horizontally extending upper frame beam and a vertically extending lower frame beam extending downward from the upper beam.

As shown and embodied in FIG. 1, the frame means includes an L-shaped frame 38 made of formed steel. Frame 38 includes an upper frame beam 40 which extends horizontally and a lower frame beam 42 rigidly fastened to and extending downward from the upper frame beam 40. Frame beams 40 and 42 may be connected by fasteners such as bolts or rivets or may be welded together. The upper portion of the frame means generally corresponds to the upper portion of frame 38, which in the embodiment of FIG. 1 is generally upper frame beam 40. The lower portion of the frame means would generally correspond to the lower portion 42 of frame 38, in the embodiment of FIG. 1.

According to the present invention, support means are attached to the upper portion of the frame means for supporting the frame means from above and for guiding the frame means along a path around the load. It is preferable that the support means includes a horizontally extending support beam attached to a mounting member. It also is preferable that the mounting member include either a wall or a stand. It further is preferable that a stand would include a vertically extending beam and a base having horizontal base beams which extend outward from the vertically extending beam of the stand in a direction generally parallel to the path around the load and over an angular extent substantially less than the angular extent of the path around the load.

As shown in FIG. 1, the support means includes a support 43 such as horizontally extending support beam 44 which is attached to a mounting member including a stand 46 which rests on the floor 48. Horizontally extending support beam 44 is rigidly secured to stand 46 by fasteners such as bolts or rivets, or are welded together. Stand 46 includes a vertically extending stand beam 50 and a base 52.

Base includes horizontal base beams 54 which extend outward from vertically extending stand beam 50 and are rigidly connected to stand beam 50. Base beams 50 extend generally parallel to the path 56 around the load 22 which is defined by two joined linear sections of steel tubing **54*a* and 54*b***.

Figure 3:
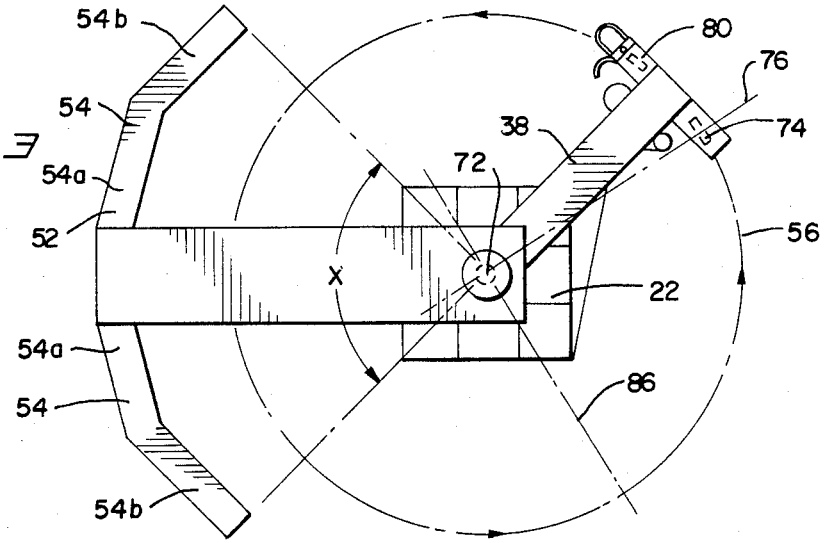
FIG. 3 is a top view of the stretch wrapping device of FIG. 1 in a third position during a stretch wrapping operation.

Base beams 54 extend over an angular extent substantially less than the angular extent of path 56. As best seen in FIG. 3, the angular extent of base beams 54 is shown by the angle X which, in this embodiment, is approximately 90 degrees. By a construction which allows the angular extent of base 52 to be substantially less than the angular extent of path 56, the floor around stretch wrapping device 20 is unencumbered, space is saved, and the load 22 easily can be transported into and out of the wrapping position inside of path 56.

Figure 4:
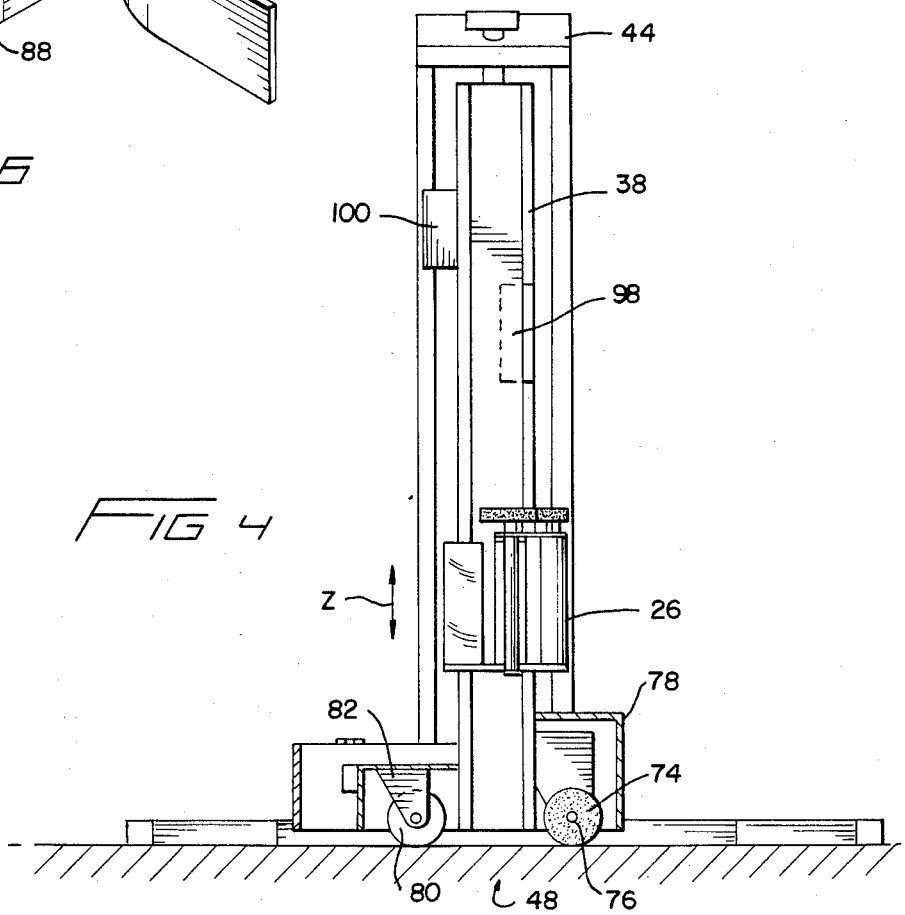
FIG. 4 is a left side view of the stretch wrapping device illustrated in FIG. 1.
Figure 5:
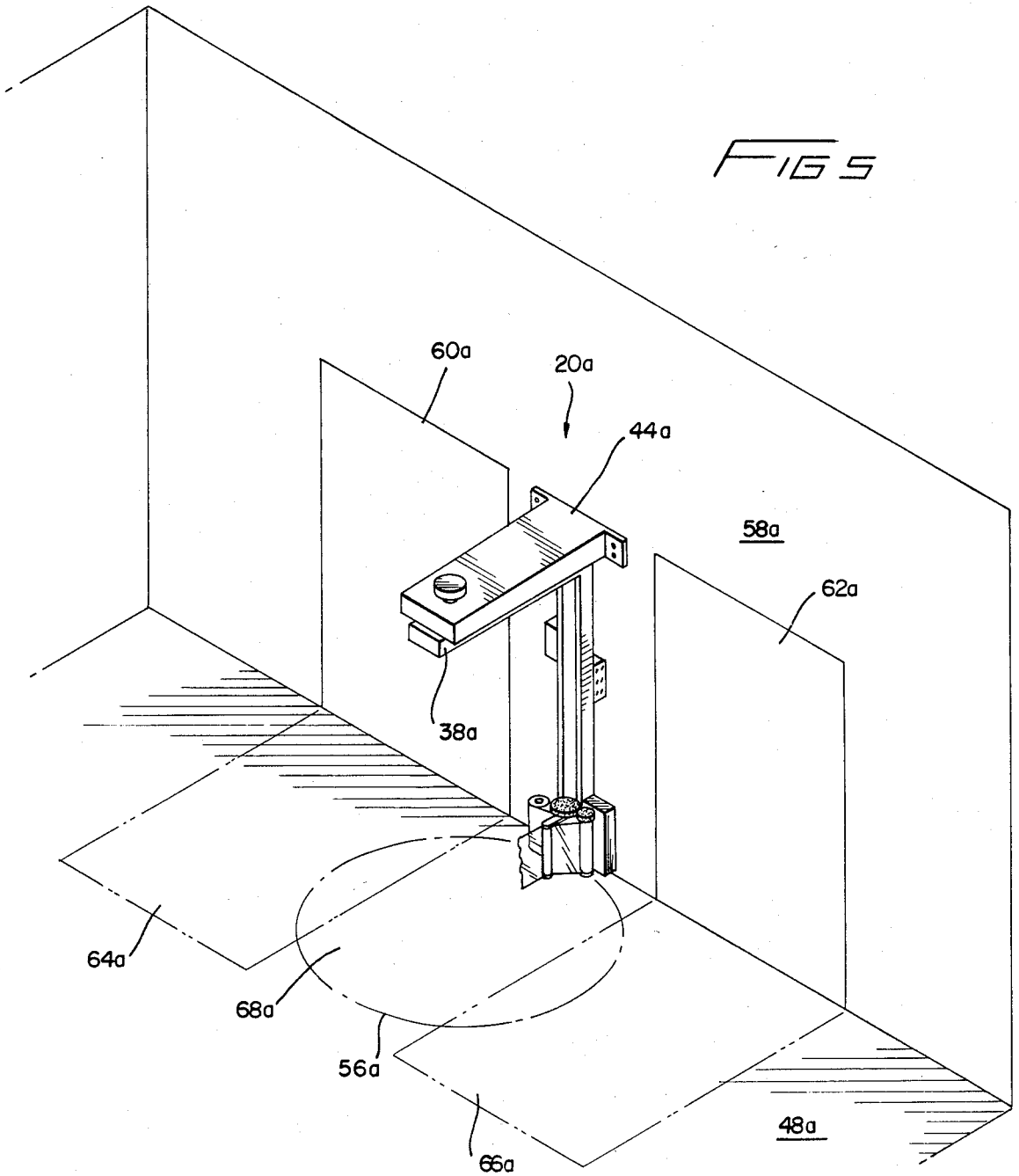
FIG. 5 is a perspective view of another embodiment of a stretch wrapping device incorporating the teachings of the present invention.

As embodied in a second embodiment shown in FIG. 5, the support means includes a horizontally extending support beam **44*a* attached to a mounting member which includes vertical wall 58*a*. Support beam 44*a* is attached to wall 58*a* by connectors such as bolts or rivets in a rigid fashion. The embodiment shown in FIG. 5 is especially space saving since no stand engages and blocks the floor at any point and the stretch wrapping device 20*a* can be stored in an extremely compact shape in between two bay doors 60*a* and 62*a* having adjacent loading areas 64*a* and 66*a*. Also, there is an unobstructed floor area between each of loading areas 64*a* and 66*a*, and wrapping area 68*a* inside wrapping path 56*a* through which a load may be transported for wrapping. As a result, one stretch wrapping device 20*a* may be positioned between even the most closely spaced pair of bay doors 60*a* and 62*a* and may be used to wrap loads being loaded through both bay doors 60*a* and 62*a*. Frame 38*a* and the remainder of the embodiment shown in FIG. 5 are similar to the corresponding components described in relation to the first embodiment shown in FIGS. 1 through 4 and 6. A stretch wrapping device 20 such as that shown in FIG. 1, with a base 52, can be positioned between bay doors similar to the arrangement shown in FIG. 5**.

As shown and embodied in FIG. 1, the upper portion of frame 38 is attached to a shaft 69 by a pin 84. Shaft 69 is positioned in a rigid journal bearing 70 (not shown in detail) having a vertical axis 72. Bearing 70 is fixed to support beam 44 and permits frame 38 to rotate in a circle along path 56 and about vertical axis 72 relative to the floor 48 and support 43. Support 43 is freestanding on floor 48, but immovable relative to floor 48 during operation of stretch wrapping device 20. Bearing 70 also supports frame 38 from above, thereby preventing vertical translational movement of frame 38. By serving as a pivot point for frame 38, support 43 guides frame 38 along path 56 around the load 22.

According to the present invention, drive means are attached to the lower portion of the frame means for engaging a floor, supporting the frame means from below, and driving the frame means on the floor along the path around the load. It is preferable that the drive means includes a motor-driven wheel which engages the floor. It also is preferable that the motor-driven wheel rotates about a horizontal axis which intersects said vertical axis. It further is preferable that a free-wheeling wheel is attached to the lower portion of the frame means for engaging the floor and stabilizing the frame means about the horizontal axis of the motor-driven wheel.

As best shown and embodied in FIG. 4, the drive means includes a motor-driven wheel which engages the floor 48 and includes rubber traction wheel 74 which rotates about a horizontal axis 76. As shown in FIG. 3, horizontal axis 76 intersects vertical axis 72 so that while wheel 74 is translationally fixed relative to frame 38, it drives frame 38 along path 56 in a circle. As best shown in FIG. 4, motor and reducer 78 are connected to wheel 74 to rotate wheel 74 so that frame 38 is driven around path 56.

A free-wheeling wheel 80 is mounted on frame 38 by a caster connector 82 which allows free-wheeling wheel 80 to pivot and be directed along path 56 as shown in FIG. 3. Free-wheeling wheel 80 is spaced angularly from motor-driven wheel 74 about path 56 and engages the floor and stabilizes the frame 38 about horizontal axis 76.

Although it is preferable to use a motor-driven wheel to drive the frame along the path around the load, it is also possible to be within the scope of the invention, according to another embodiment of the invention, by replacing the drive means with means such as a free-wheeling wheel attached to the lower portion of the frame for engaging the floor, supporting the frame from below, and permitting the frame means to roll on the floor along the path around the load while being pushed by an operator or driven by another motive force or the like.

According to the present invention, it is preferable that the drive means is offset from the vertical axis along a radial line, and means are provided between the drive means and the support means for permitting the frame to rotate about a horizontal axis perpendicular to said radial line. It is further preferable that those means between the drive means and the support means permit vertical displacement of the drive means while preventing transmission of forces resulting from said vertical displacement to the support means.

As shown and embodied in FIG. 1, the means provided between the drive means and the support means includes a pivot pin 84 which passes through frame 38 and shaft 69. As a result, frame 38 pivots about pivot pin 84 relative to shaft 69 along arc Y. Such pivoting allows the drive means to drive along an uneven floor, thereby undergoing vertical displacement, without transmitting forces to support 43. As shown in FIG. 3, pivot pin 84 extends along axis 86 which is horizontal and perpendicular to horizontal axis 76. Axis 86 also intersects vertical axis 72. Although pivot pin 84 relieves stress on support 43 due to rotation of frame 38 around axis 86, it also allows bearing 70 to assist in providing the minimum stabilization needed about axis 76. Only a minimum amount of stability is needed in this direction because of the positioning of drive wheel 74 and the line of force which is exerted on the frame by film web 24 during wrapping.

The arrangement described above through its effective management of forces on the system, allows the components of a stretch wrapping device to be simple, lightweight, space saving, unobtrusive, and low in cost, while high in effectiveness and durability.

According to the present invention, means are provided for detecting a foreign object in the path of the frame means and responsively stopping the drive means from driving the frame means along the path. It is preferable that the detecting means is mounted on the lower portion of the frame means and detects a foreign object by being physically displaced by the object.

Figure 7:
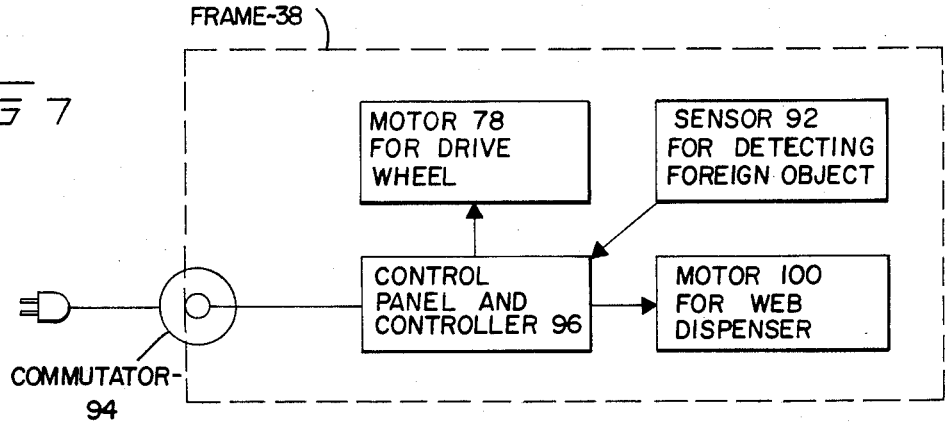
FIG. 7 is a schematic block diagram of the system for electrically controlling the stretch wrapping device according to the present invention.

As shown and embodied in FIG. 6, the means for detecting a foreign object includes a fender 88, made of a strip of flexible, but elastically recoverable material, which surrounds at least the leading portion of the lower portion of frame 38 and is preferably proximate to floor 48. Fender 88 includes a second strip 90 which overlies a sensing device 92 such as a photocell or a mechanical switch which opens a circuit when fender 88, and therefore strip 90, is displaced relative to sensing device 92 and the remaining portion of frame 38. Such displacement occurs when fender 88 encounters a foreign object. As shown in FIG. 7, when sensor 92 is opened, it causes the controller 96 to stop the motor-driven drive wheel 74 from rotating by cutting off power to that motor 78 and stopping frame 38 from moving along path 56.

According to the present invention, commutator means supply current to a controller on the frame means for controlling electrical components on the frame means. As shown in FIG. 1, commutator means includes a commutator 94 having its stator attached to the conductors of a power cord 95. The rotor of commutator 94 rotates with frame 38 and is connected to controller 96 in control panel 98 which is mounted on frame 38 in easy reach of an operator for programming the control sequence of stretch wrapping device 20.

The advantage of using commutator 94 for supplying current to a controller on frame 38 rather than having a controller on support 43 is that the commutator need only provide a single line of current rather than many lines to provide various control signals for controlling various electrical components mounted on the frame 38.

According to the present invention, the electrical components controlled by the controller include a controller for selectively operating the drive means. For purposes of safety, the controller preferably would have a delay sequence for starting the motor for the drive wheel after a time delay so that the operator would be able to step back from the wrapping area. The motor and reducer 78 would be programmed to stop after predetermined number of wraps around load 22. The wrap load could then be removed from the wrapping area and a new load to be wrapped could be placed in the wrapping area.

According to the present invention, the electrical components preferably include a controller for vertically translating the web dispenser relative to the frame during wrapping.

As shown and embodied in FIG. 4, web dispenser 26 is driven by a motor 100 in the direction of arrow 2, to reciprocate along a portion of the vertical extent of frame 38 during wrapping, so that load 22 will be wrapped along its full height when the width of web 24 is less than the height of load 22. Such vertical translation of the web dispenser for such a purpose is conventional and known in the art as an alternative to wrapping a load with a web having a width equal to the full height of the load. However, such vertical translation must be controlled during the wrapping process. As shown in FIG. 7, controller 96, which is mounted on frame 38 controls the sequence and operation of the motor 100 for translating web dispenser 26 vertically along frame 38 during wrapping.

Other electrical and mechanical components mounted on frame 38 may be similarly controlled by controller 96 which is mounted on frame 38.

Additional advantages and modifications will readily occur to those skilled in the art. The invention in its broader aspects is, therefore, not limited to the specific details, representative apparatus, and illustrative examples shown and described. Accordingly, departures may be made from such details without departing from the spirit or scope of the general inventive concept as defined by the appended claims and their equivalents.

What is claimed is:

1. An apparatus for wrapping a load with a web dispensed from a web dispenser comprising:

frame means for supporting and revolving the web dispenser around the load and about a vertical axis, the frame means having an upper portion and a lower portion;

support means attached to the upper portion of the frame means for supporting the frame means from above and for guiding the frame means along a path around the load; and drive means attached to the lower portion of the frame means for engaging a floor, supporting the frame means from below, and driving the frame means on the floor along the path around the load.

2. The apparatus of claim 1 wherein the drive means includes a motor-driven wheel which engages the floor.

3. The apparatus of claim 2 wherein the motor-driven wheel rotates about a horizontal axis which intersects said vertical axis.

4. The apparatus of claim 3 including a free-wheeling wheel attached to the lower portion of the frame means for engaging the floor and stabilizing the frame means about the horizontal axis of the motor driven wheel.

5. The apparatus of claim 1 including means between the drive means and the support means for permitting vertical displacement of the drive means while preventing transmission of forces resulting from said vertical displacement to the support means.

6. The apparatus of claim 1 wherein the drive means is offset from said vertical axis along a radial line, and means are provided between the drive means and the support means for permitting the frame to rotate about a horizontal axis perpendicular to said radial line.

7. The apparatus of claim 6 wherein said vertical axis and said horizontal axis intersect.

8. The apparatus of claim 1 including means for detecting a foreign object in the path of the frame means and responsively stopping the drive means from driving the frame means along the path.

9. The apparatus of claim 8 wherein the detecting means is mounted on the lower portion of the frame means and detects a foreign object by being physically displaced by the object.

10. The apparatus of claim 1 wherein the frame means includes a horizontally extending upper frame beam and a vertically extending lower frame beam extending downward from the upper frame beam.

11. The apparatus of claim 1 wherein the support means includes a horizontally extending support beam attached to a mounting member.

12. The apparatus of claim 11 wherein the mounting member includes a wall.

13. The apparatus of claim 11 wherein the mounting member includes a stand which engages the floor.

14. The apparatus of claim 13 wherein the stand includes a vertically extending stand beam and a base.

15. The apparatus of claim 14 wherein the base includes horizontal base beams which extend outward from the vertically extending stand beam.

16. The apparatus of claim 15 wherein the base beams extend generally parallel to the path around the load and over an angular extent substantially less than the angular extent of the path.

17. The apparatus of claim 1 including commutator means for supplying current to a controller on the frame means for controlling electrical components on the frame means.

18. The appparatus of claim 17 wherein said electrical components include a controller for selectively operating the drive means.

19. The apparatus of claim 17 wherein said electrical components include a controller for vertically translating the web dispenser relative to the frame during wrapping.

* * * * *